US008075454B2

(12) United States Patent
Piggins

(10) Patent No.: US 8,075,454 B2
(45) Date of Patent: Dec. 13, 2011

(54) COMPACT GYM

(76) Inventor: Darren Piggins, Georges Hall (AU)

( * ) Notice: Subject to any disclaimer, the term of this patent is extended or adjusted under 35 U.S.C. 154(b) by 6 days.

(21) Appl. No.: 12/279,540

(22) PCT Filed: Feb. 6, 2007

(86) PCT No.: PCT/AU2007/000124

§ 371 (c)(1),
(2), (4) Date: Aug. 19, 2008

(87) PCT Pub. No.: WO2007/092987

PCT Pub. Date: Aug. 23, 2007

(65) Prior Publication Data

US 2009/0017997 A1 Jan. 15, 2009

(30) Foreign Application Priority Data

Feb. 15, 2006 (AU) ..... 2006900746
Jun. 23, 2006 (AU) ..... 2006903395

(51) Int. Cl.
*A63B 22/12* (2006.01)
*A63B 21/06* (2006.01)

(52) U.S. Cl. ..... 482/62; 482/94

(58) Field of Classification Search ..... 482/60, 482/62, 72, 904, 57, 93, 94, 133
See application file for complete search history.

(56) References Cited

U.S. PATENT DOCUMENTS

| | | | | | |
|---|---|---|---|---|---|
| 3,759,512 | A * | 9/1973 | Yount et al. | 482/62 |
| 4,431,181 | A * | 2/1984 | Baswell | 482/38 |
| 4,880,227 | A * | 11/1989 | Sowell | 482/102 |
| 5,217,422 | A * | 6/1993 | Domzalski | 482/138 |
| 6,447,428 | B1 * | 9/2002 | McKillip | 482/57 |
| 6,764,429 | B1 * | 7/2004 | Michalow | 482/51 |
| 6,976,941 | B2 * | 12/2005 | Britt | 482/94 |
| 2002/0091043 | A1 * | 7/2002 | Rexach | 482/98 |
| 2006/0019804 | A1 * | 1/2006 | Young | 482/93 |
| 2006/0100069 | A1 * | 5/2006 | Dibble et al. | 482/98 |

* cited by examiner

*Primary Examiner* — Allana Lewin
(74) *Attorney, Agent, or Firm* — Michael Molins

(57) ABSTRACT

Disclosed in this specification is a compact gym that comprises both a recumbent exercycle and a weight system. The recumbent exercycle may be rotated by 180° to offer users a greater variety of workouts. The compact gym's various components may be folded into a cupboard for storage.

20 Claims, 11 Drawing Sheets

COMPACT GYM

FIELD OF THE INVENTION

The invention relates to gym equipment and more particularly to a weight pulley system with folding and pivoting recumbent exercycle.

BACKGROUND OF THE INVENTION

The invention seeks to provide a compact and convenient exercise machine, primarily for residential use. The machine may be built into its own storage cupboard and has optional wheels that support it. Accordingly, the device can be hidden from view and rolled from location to location on its own wheels.

The invention may also have a swivelling seat that allows the same weight set to be used for flexion and extension exercises.

OBJECTS AND SUMMARY OF THE INVENTION

It is an object of the invention to provide a compact exercise device.

It is another object of the invention to provide a compact exercise having a combination of swivelling recumbent cycle and weight set.

Accordingly, there is provided a compact gym comprising a frame to which is attached a recumbent exercycle that is adapted to be at least partially received into a space defined by the frame. A weight pulley system is supported by the frame.

BRIEF DESCRIPTION OF THE DRAWING FIGURES

FIG. 5 (*b*) is a side elevation view of another example of the recumbent exercycle;

FIG. 5 (*c*) is a perspective view of the stabilizing brace members for the exercycle;

BEST MODE AND OTHER EMBODIMENTS OF THE INVENTION

Figure 1:
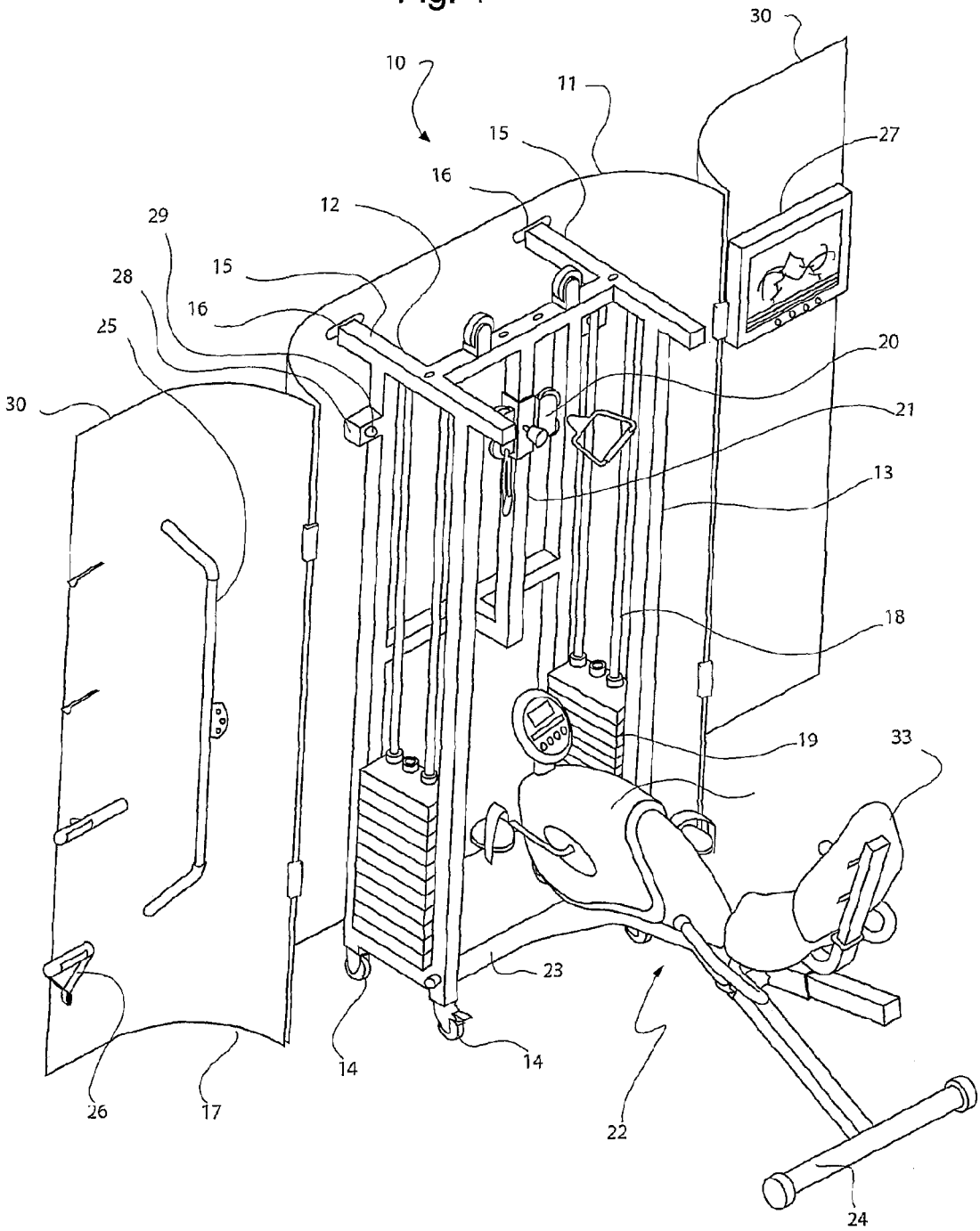
FIG. 1 is a perspective view of a device in accordance with the teachings of the present invention, with the doors open.

As shown in FIG. 1, an exercise device 10 comprises a specially adapted cupboard or enclosure 11 into which is fitted a metal frame 12. In this example, the frame 12 comprises four uprights in lateral pairs 13 that are supported above the floor by lockable castor wheels 14. A pair of upper horizontal rails 15 interconnect each lateral pairing of uprights 13 and extends somewhat past the rear uprights so as to terminate in a bracket 16. The rear panel of the cupboard 11 is fixed to the brackets 16 so that the lower margin 17 of the cupboard 11 rests above the floor. In this way, the entire device can be moved about on the castors 14 when in the stored position depicted in FIG. 2. There may further be fix plates 28 that extend from the metal frame 12. Each fix plates 28 has one or more through openings 29, for bolting the exercise device 10 to a wall or into a space such as a built-in wardrobe.

A pair of vertical guide rods 18 is located between each of the lateral pairs of uprights 13. These guide rods 18 comprise and are used to locate the weight sets 19 that are carried by the internal frame. An adjustable pulley mechanism 20 is supported by a vertical post 21 that is also carried by the frame. The pulley mechanism 20 is vertically adjustable on the post 21. Conventional handles are attached to a wire rope or cord system so that the weights 19 can be raised and lowered by the user.

As shown in FIG. 1, a recumbent exercycle 22 is mounted on a sub-frame having a transverse front support 23 and a transverse rear support 24. The front support 23 is pivotally attached to both of the front uprights 13. In this example, the exercycle 22 has a folding seat back 33 that folds forward into close proximity with the resistance housing 25.

As further shown in FIG. 1, the interior of the cupboard 11 can be used to store accessories such as a clarke handle 25, spare grips 26 or other parts as required. The interior of one of the doors may be also used to support a video monitor or television 27.

Figure 2:
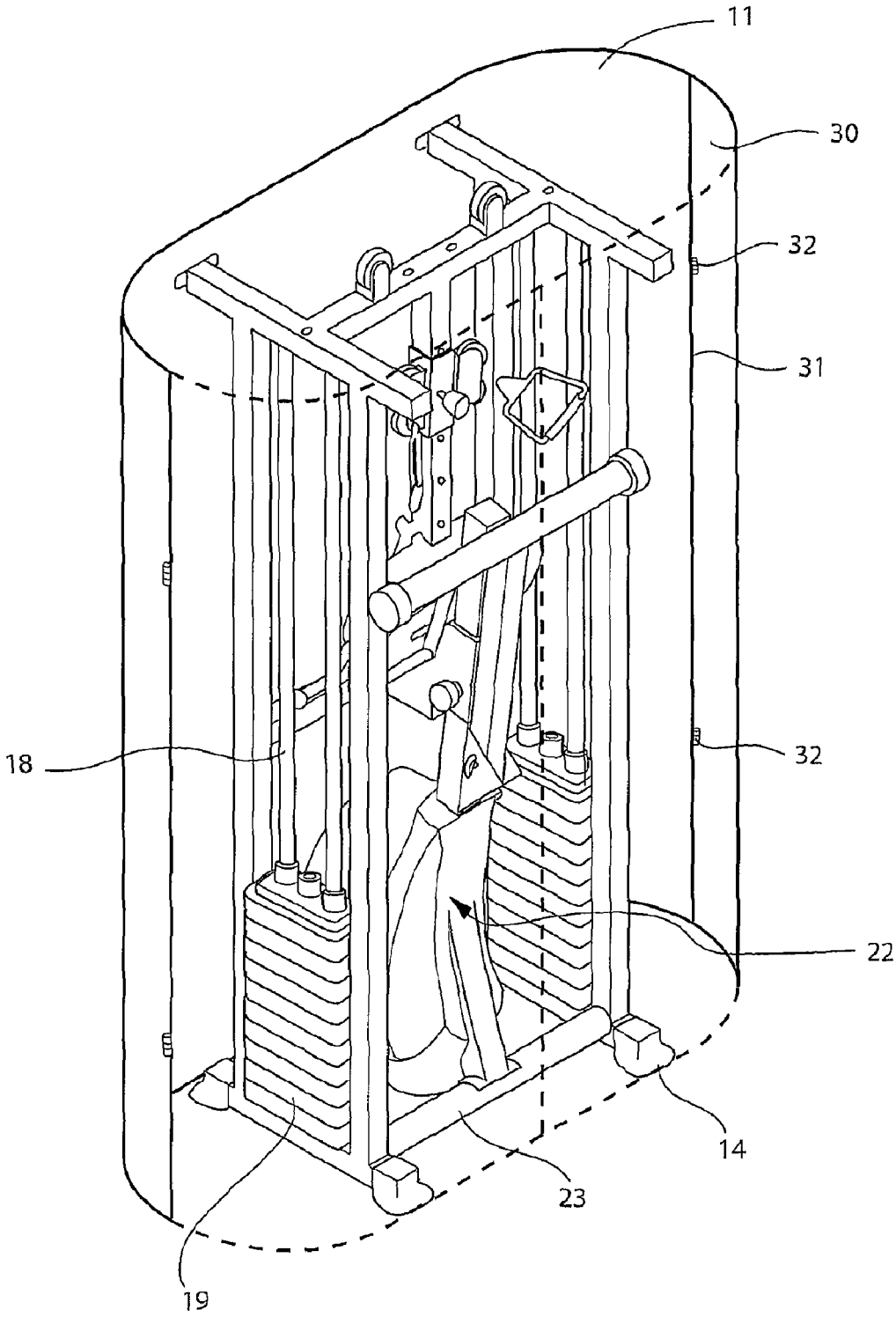
FIG. 2 is a perspective view of the device of FIG. 1, with the doors closed.

As shown in FIG. 2, the entire workings of the device including the internal frame and the recumbent exercycle 22 can be stored within the cupboard 11 when the doors 30 are fully closed. Note that in this example, the cross sectional form of the cupboard resembles an oval although the front and back are essentially flat. Hinges 32 between the curved side portions of the rear panel and each of the doors are carried along a transverse midline 31. Note that the recumbent cycle is stored substantially within the volume of the frame.

Figure 3:
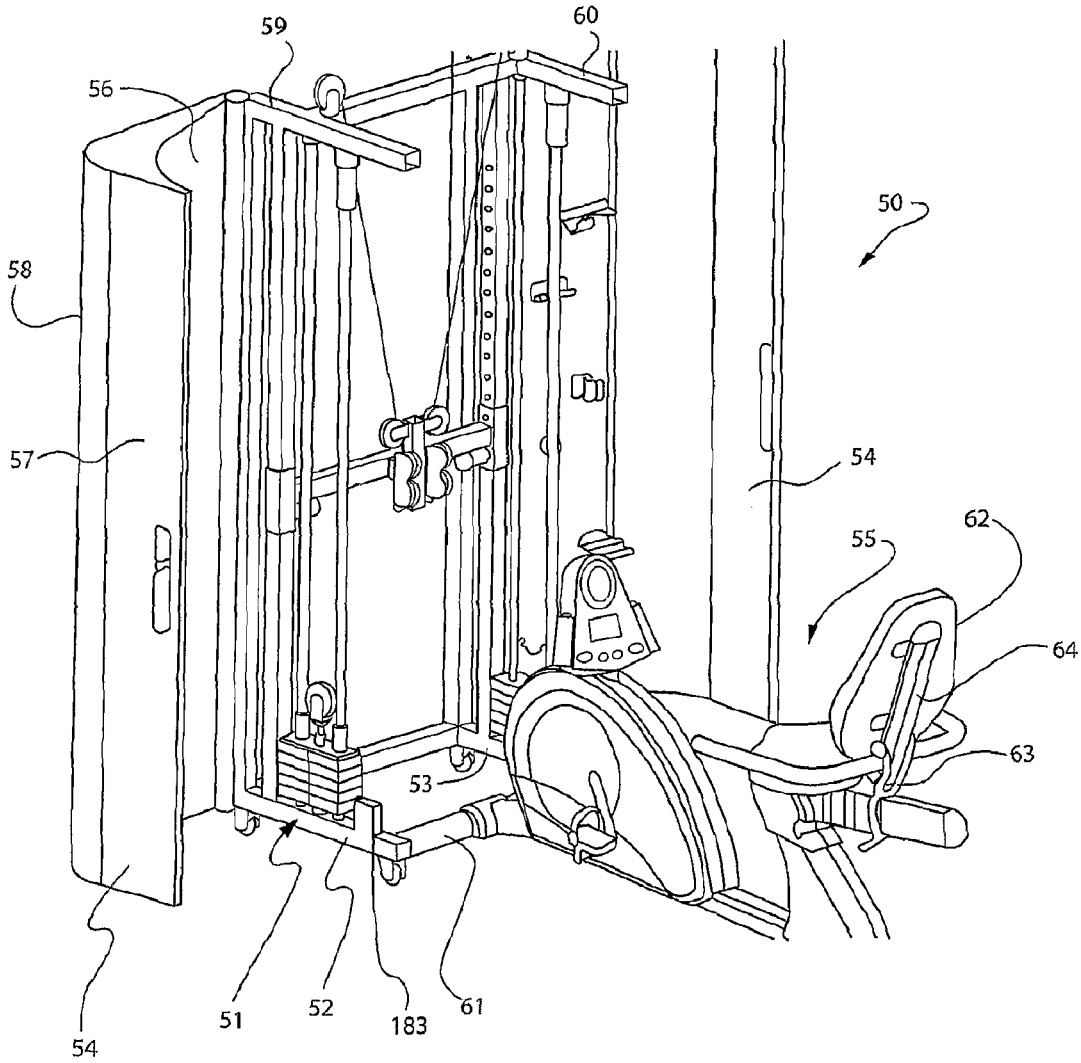
FIG. 3 is a perspective view of another embodiment of a compact gym constructed in accordance with the teachings of the present invention.

As shown in FIG. 3, further embodiment of the invention 50 comprises a frame having four uprights in lateral pairs that are supported above the floor by a pair of lower horizontal rails 52, 53. When the device is folded into its compacted arrangement (see FIG. 6) the hinged doors 54 conceal the frame and its recumbent exercycle 55. Note that the doors have side panels 56 that join front panels 57 via rounded longitudinal corner 58. The doors are hinged to the rear extremities of the upper and lower horizontal rails 52, 53, 59, 60.

In order to fit the recumbent exercycle 55 into the space defined by the frame 51 and the doors 54, the front end of the recumbent exercycle 55 is supported by a horizontal pivot shaft 61. The ends of the pivot shaft 61 are supported by bearings that are attached to the forward portions of the lower horizontal rails 52, 53. As will be explained, the pivot shaft 61 is adapted to lock in both the compact and deployed position. In the interest of compactness, the backrest 62 of the exercycle's chair also folds about a hinge 63 located at the lower end of the back rest support 64.

Figure 4:
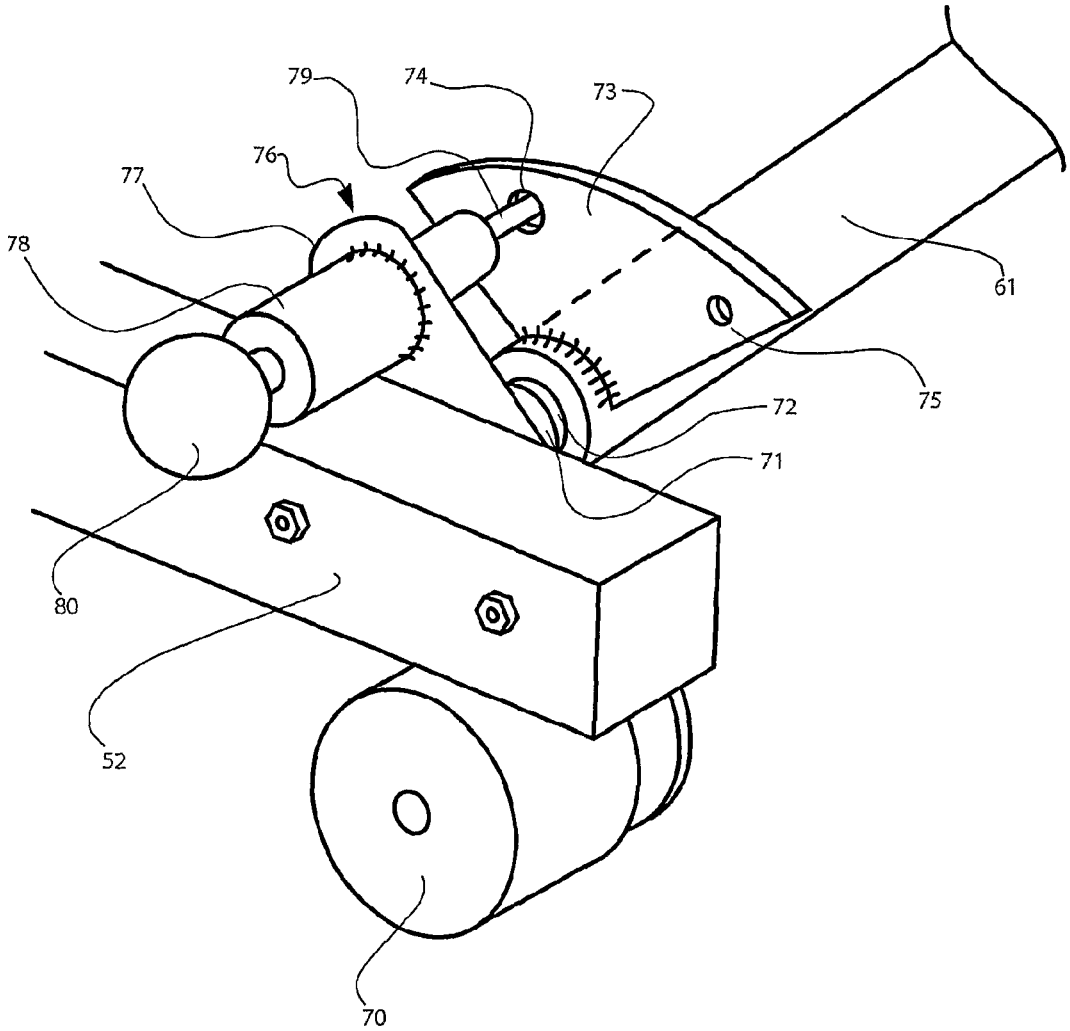
FIG. 4 is a perspective view illustrating the locking arrangement between the frame and the pivoting recumbent exercycle.

The locking mechanism between the pivot shaft 61 and the lower horizontal rail 52 is shown in more detail in FIG. 4. As illustrated, the horizontal rail 52 is supported above the floor by a pair of castor wheels or rollers 70. The inside edge of the rail 52 supports a bearing 71. The bearing supports a stub shaft 72 that is associated with pivot shaft 61. In some embodiments the bearing 71 may support the pivot shaft 61 directly. The positioning of the exercycle in its locked compact and locked extended positions is determined by a pivot plate 73. The pivot plate 73 is in the form of an arc of a disk having at least a pair of holes 74, 75 that are located at 90° to one another with reference to the axis of rotation of the pivot shaft 61. The arrangement in FIG. 4 is depicted in its extended position. A spring biased retainer assembly 76 comprises a plate 77 that is attached to the rail 52. The plate 77 supports a cylindrical body 78 within which is contained a reciprocating pin 79 having a knob or handle 80. A compression spring within the cylinder 78 urges the pin 79 into engagement with the positioning holes 74, 75. When the pin 79 is retracted, the pivot shaft 61 can be rotated about its longitudinal axis.

Figure 5A:
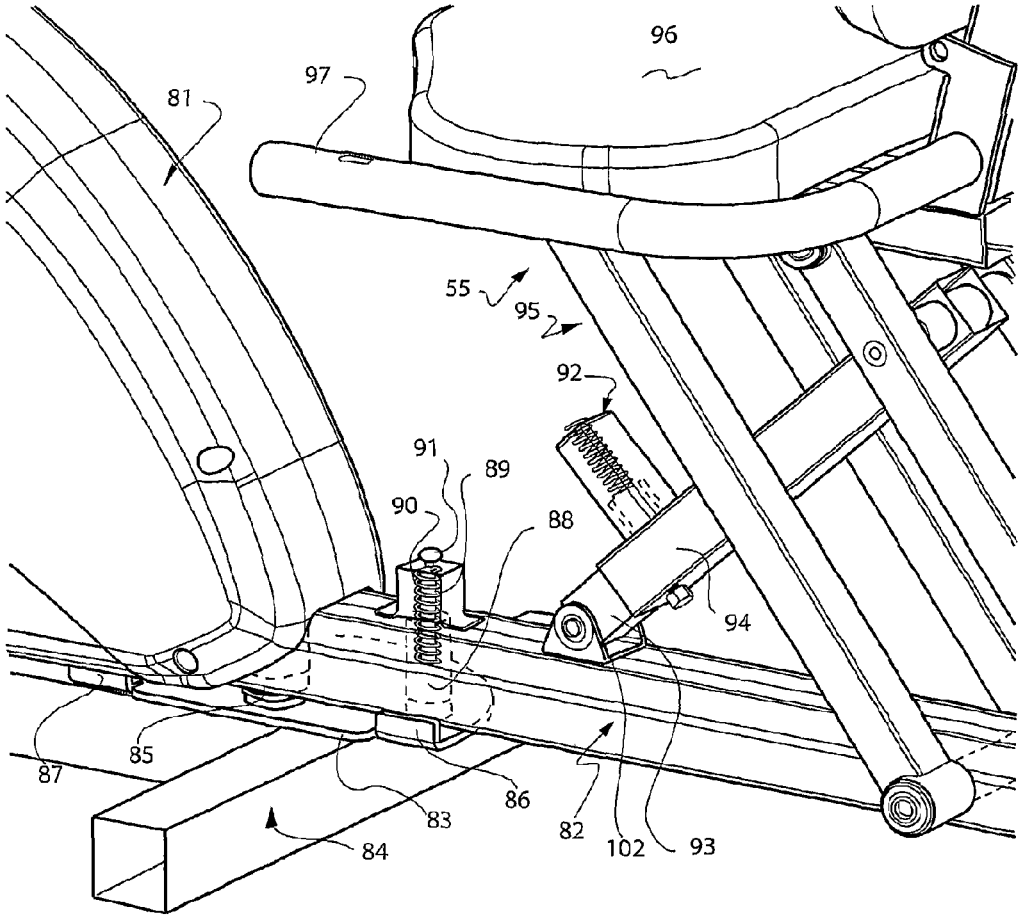
FIG. 5 (*a*) is a perspective details of the swivel mechanism associated with the recumbent exercycle.
Figure 5B:
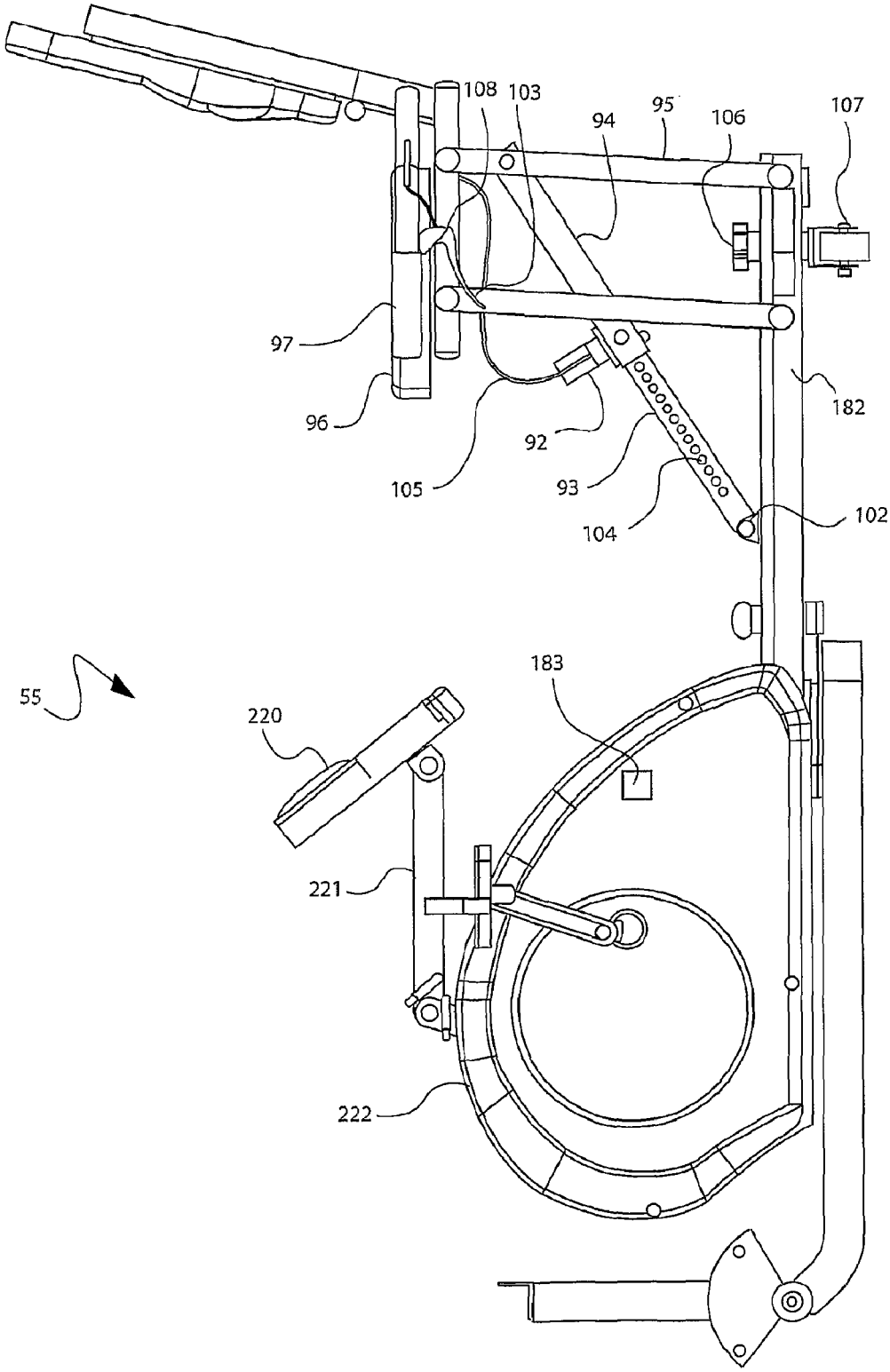
Figure 5C:
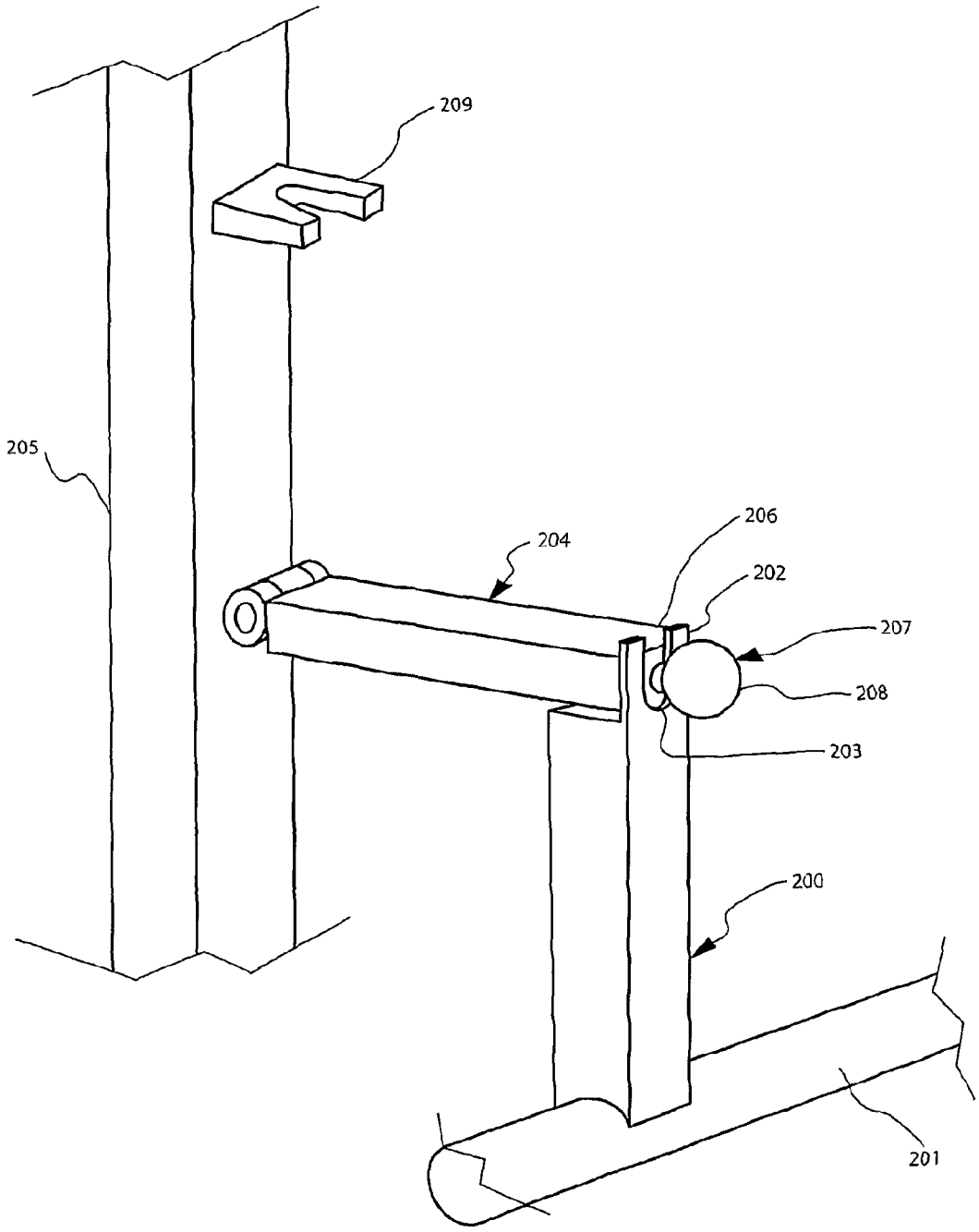

As shown in FIG. 5(*a*), the recumbent exercycle is adapted to swivel in a horizontal plane and can be locked in at least two positions. A first operative position is depicted in FIG. 3. In this first position, the operator of the exercycle 55 faces the frame 51. In the second operative position, the operator faces away from the frame 51. This allows the weights associated with the frame to be used during both flexion and extension of the arms and upper body generally. As shown in this embodiment, the resistance mechanism 81 and the adjustable seat 55 are carried by a sub-frame 82. The sub-frame 82 is mounted for swivelling action above a swivel plate 83 that is attached to the ground-engaging main frame 84. A vertically oriented pin and bearing assembly 85 interconnects the sub-frame 82 with the main frame 84. The swivel plate 83 further comprises a pair of upright ears 86, 87 that limit the rotational travel of the sub-frame 82.

Located on the same side of the sub-frame 82, but on different sides of the pin and bearing assembly 85, the ears 86, 87 define two swivelling orientations that are approximately 180° from one another. The sub-frame can be locked into either of these two orientations by virtue of a reciprocating vertical pin 88 that is carried by the sub-frame 82 and urged toward engagement with the main frame 84 (through the swivel plate 83) by a compression springs 89. In this embodiment, the compression spring 89 is contained within a protective housing go that is mounted onto an upper surface of the sub-frame 82. The pin 88 can be retracted against the bias of the spring 89 by, for example, a knob 91 attached to the pin 88 by a shaft that runs through the centre of spring 89. Thus, retracting the pin 88 from its opening in the main frame allows the sub-frame 82 to swivel from one operative position to the other. It will be appreciated that the openings through the sub-frame 82 and main frame 84 that engage with the locking pin 88 may be reinforced with appropriate cylindrical members, as required.

FIG. 5 (*a*) also illustrates that a pin locking mechanism, of the type used between the sub-frame 82 and main frame 84, is deployed on the adjustable seat. This second spring biased locking pin arrangement 92 serves to lock together and thereby adjust the first and second telescopic portions 93, 94 of a diagonal brace that is part of the parallelogram mechanism 95 to which the seat 96 and backrest are ultimately attached. The telescopic portion 93 of the diagonal brace can pivot within a bracket 102 which is attached to the sub-frame 82. This first telescopic portion 93 may contain several holes to receive the spring biased locking pin arrangement 92, to allow the length of the diagonal brace to be adjusted by locking the other telescopic portion 94 at different positions. Alternatively, a different mechanism can be employed to allow for continuous adjustment of the diagonal brace. Note that the user's grab handles 97 are located laterally of the seat 96 and only slightly above the level of the seat.

Another example of the recumbent exercycle 55 is depicted in FIG. 5 (*b*). This example has the same parallelogram arrangement 95 as discussed before. In this embodiment there is an array of regularly spaced holes 104 along the lower telescopic portion 93. The holes 104 are sized to receive the second spring biased locking pin arrangement 92. These holes define the relative positions of the telescopic portions 93, 94. There may further be a seat position adjustment mechanism 181 that comprises be a lever 103 located beneath, and can be pulled towards, a grab handle 97. The operation of the lever 103 provides control over a cable 104, which is routed from the lever joint 108 to the interior of the second spring biased locking pin arrangement 92. The cable 105 permits the user to control the spring biased locking pin arrangement 92 and change the seat position.

Preferably, the position of a display 220 mounted on the exercycle 55 is also adjustable. In this example, the display 220 is pivotally attached to a support rod 221. This attachment allows users to adjust their view angles for the display 220. The support rod 221 may further be pivotally mounted onto the resistance housing 222. The support rod 221 can thus be folded towards the seat 96, for both view angle adjustment and storage purposes.

Further referring to FIG. 5(*b*), there may be a wheel locking mechanism 106 which attaches a wheel 107 to the sub-frame 82. The wheel may be locked to travel in a direction perpendicular to the sub-frame 82. Alternatively, the wheel 107 may be a swivelling wheel.

In some embodiments, the horizontal pivot shaft may further incorporate stabilizing features for steadying the exercycle. For example, as shown in FIG. 5 (*c*), a first brace member 200 is welded onto the horizontal pivot shaft 201. The brace member 200 comprises a bracket 202 that has an open slot 203. A second brace member 204 is pivotally attached to an upright 205, and comprises a threaded recess (not shown) formed in its free end 206. The second brace member 204 is adapted to rest on the first brace member 200, reaching just short of the slotted bracket 202, and its threaded recess being accessible through the slot 203. A screw 207 is insertable into the threaded recess through the slot 204. The screw 207 further comprises an end knob 208 that does not fit through the slot 203. The first and second brace members can be fastened together by tightening the screw 207 into the threaded recess. In this embodiment, the upright 205 further comprises a second slotted bracket 209. The second brace member 204 can be pivoted toward this second slotted bracket 209 and be fastened to it in the same manner as the first slotted bracket 202.

Figure 6:
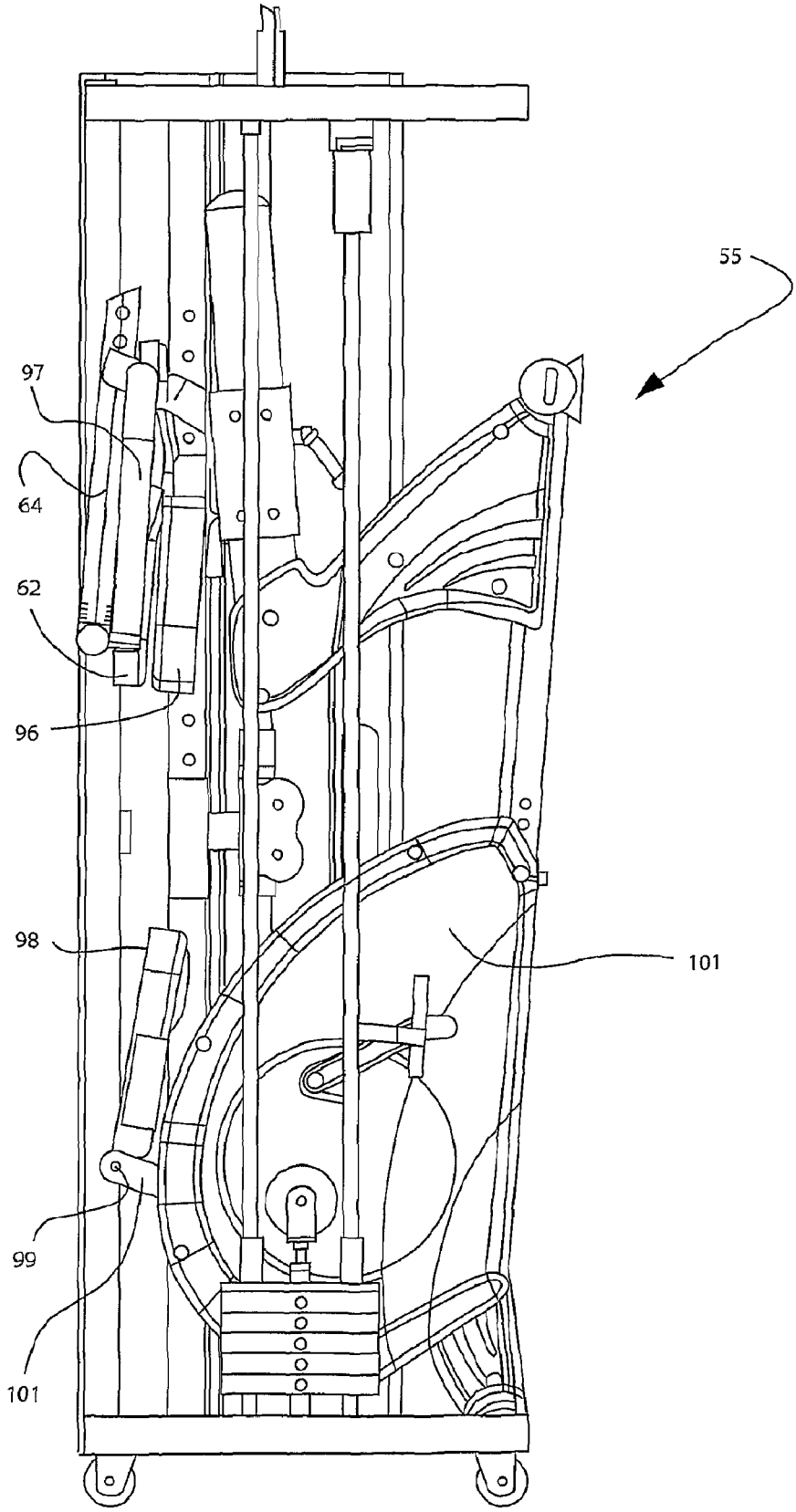
FIG. 6 is a side elevation of the device in its compacted position, the draws having been removed for clarity.

In the embodiment depicted in FIG. 6, the recumbent exercycle 55 is retracted or compacted for storage purposes. Note that to achieve greater compactness, the back rest 62, back rest support 64, and the user's grab handles 97 are folded so that they are generally parallel with the seat 96. Similarly, the instrument panel 98 is pivoted about its connection 99 with a bracket 100 carried on an outer surface of the resistance mechanism 101 of the recumbent exercycle.

Figure 7:
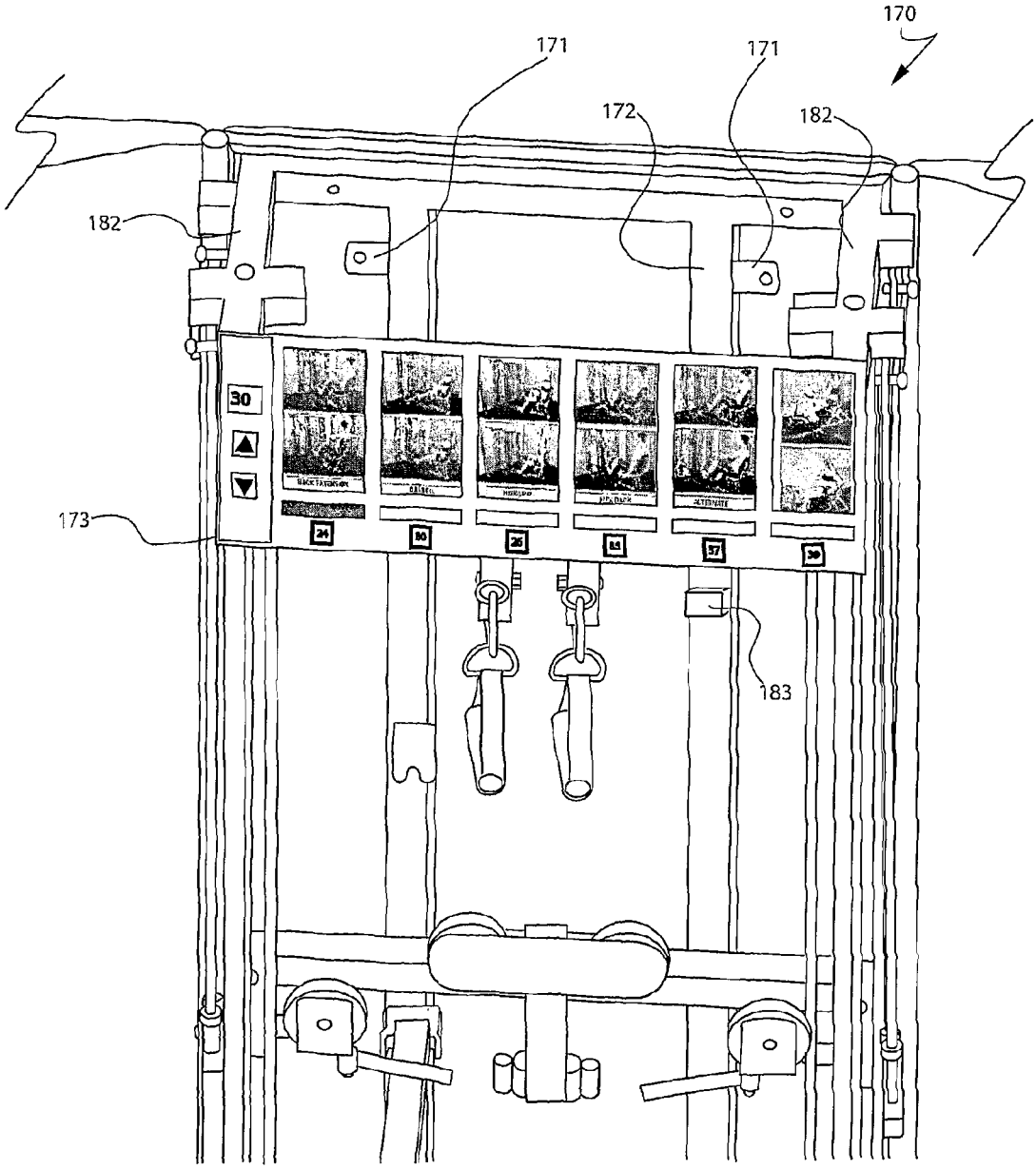
FIG. 7 is a perspective view of a third embodiment of a compact gym comprising a personal trainer screen, and constructed in accordance with the teachings of the present invention.

FIG. 7 depicts a further embodiment of the device. In this embodiment, the compact gym 170 can be attached to a wall or another surface via its fix plates 171 that extend from the metal frame 172. There may further be a personal trainer module 173 that may further have display, timer (not shown) and various workout sensors 183. The sensors 183 may be provided at various locations, such as near the weight pulley system, or the exercycle, to monitor workout statistics such as the number or repetitions and the intensity of the work out.

The module is attached to the metal frame 172. This attachment may be achieved by screwing or bolting the module 173 into insertion slots (not shown) provided in the horizontal rails 182 of the frame. The personal trainer module 173 allows the user to set or view the type and intensity of his or her current activity.

Figure 8:
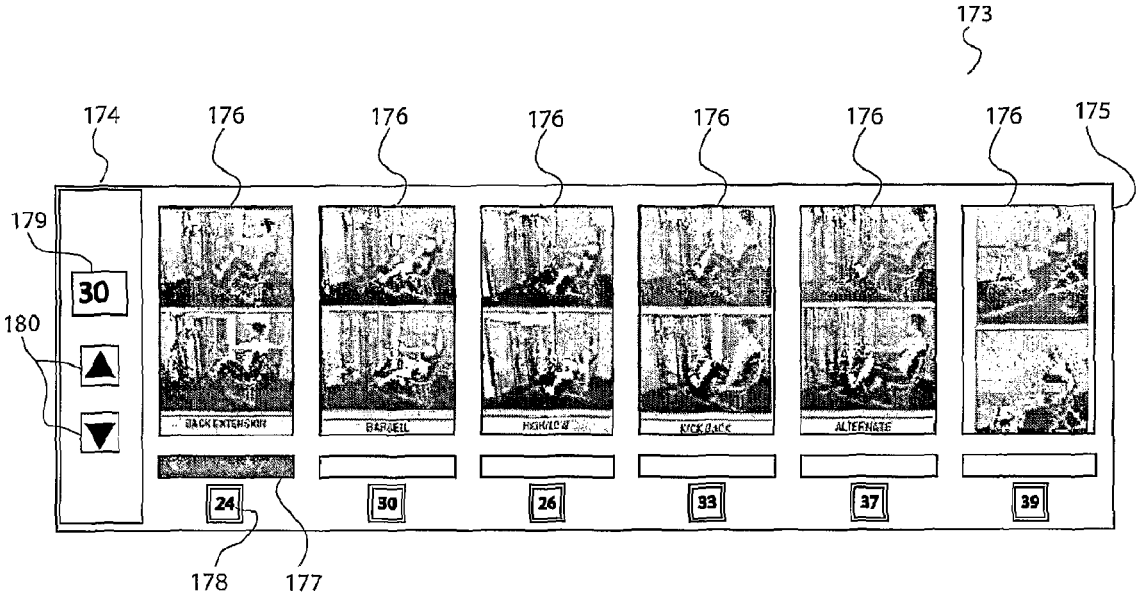
FIG. 8 is an elevation view of a personal trainer screen.
Figure 9:
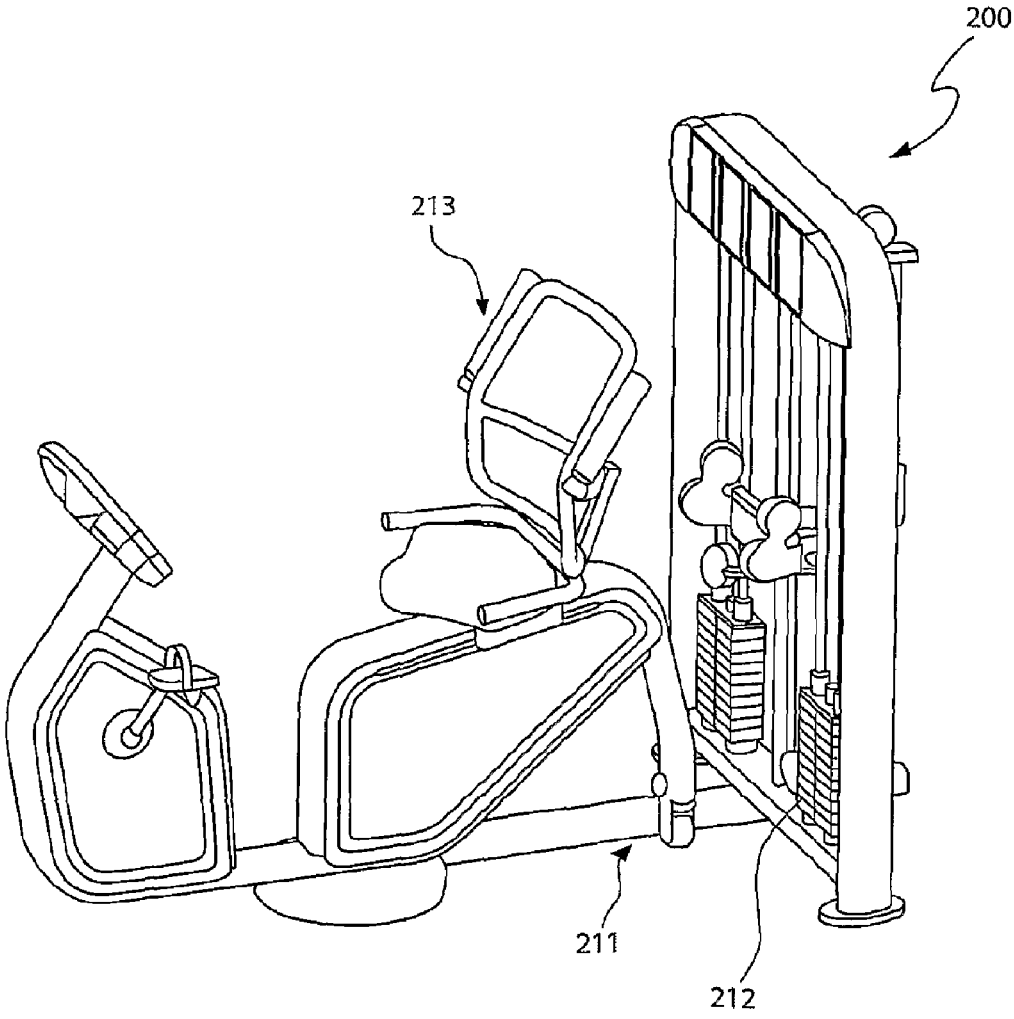
FIG. 9 is a perspective view of a further embodiment of the compact gym.

As shown in FIG. 8, the module 173 comprises a first panel 174 and a second panel 175. The second panel 175 shows an array of image displays 176. Each image display 176 shows images that correspond to one type of exercise. The array of displays shows the user the sequence of exercises in the training session. An indicator 177 below the image display 176 shows the exercise that is currently in use. For example, this indicator may be an LED light that is lit when the corresponding exercise is active. There may further be a numerical display 178 that shows the user the number of repetitions that have been done for that particular exercise. The number of repetitions is calculated by a sensor 183 (shown in FIG. 7) that senses, for example, the number of times that the pulleys have been lifted. The first panel comprises a time-interval display 179. The time-interval is the interval between different exercises, and is adjustable using a segment timer 180. In this example the segment timer is an up and a down arrow, for increasing and reducing the interval.

FIG. 19 depicts a further embodiment. Here, a commercial model of the cardio-gym 210 comprises a frame 211 that supports an adjustable weight pulley system 212 and a recumbent exercycle 213. The exercycle 213 may further be supported by a swivel plate 214 that enables the exercycle 213 to be rotated to different orientations. The frame 211 in this embodiment is preferably manufactured from heavier weight steel, compared to the frames in the previous embodiments. This stronger material allows the cardio-gym 210 to be more suitable for frequent use, such as in a shared gym.

It is also envisaged that the compact gym shown in the various embodiments described above may be manufactured from components with higher tensile strengths. They may be assembled without doors, and with the exercycle lowered all the time. Embodiments of this type are for commercial use, for example, in a gymnasium, and do not need to be light weight or foldable.

While the present invention has been disclosed with reference to particular details of construction, these should be understood as having been provided by way of example and not as limitations to the scope or spirit of the invention.

What is claimed is:

1. A compact gym, comprising:

a frame comprising uprights and a weight system, the weight system being usable in arm flexion or extension;

an exercycle, the exercycle being carried by a rotating sub-frame that is mounted to said frame, the mounted sub-frame being adapted to carry the exercycle so that the exercycle can rotate in a horizontal plane while still attached to the sub-frame so as to face or face away from the frame, the exercycle being lockable with respect to the sub-frame in two orientations these being when facing the frame or when facing away from the frame.

2. The compact gym of claim 1, wherein:

the exercycle is a recumbent exercycle from which the weight system of the frame may be used.

3. The compact gym of claim 1, wherein:

the sub-frame that carries the exercycle further comprises a transverse support that is pivotally attached to the frame, allowing the exercycle to be swivelled vertically off of a floor and into a storage orientation that is at least partially within a space defined by the frame.

4. The compact gym of claim 1, wherein:

the sub-frame carries a reciprocating locking pin that is adapted to engage with the frame to maintain the sub-frame in a stored or deployed orientation.

5. The compact gym of claim 1, wherein:

the exercycle comprises a seat supported by a parallelogram mechanism that further comprises a diagonal brace.

6. The compact gym of claim 5, wherein:

the diagonal brace comprises a first and a second telescopic portion, the portions being lockable by a locking pin arrangement.

7. The compact gym of any one of claim 1, further comprising, an exercycle seat adjustment mechanism, the mechanism further comprising a lever located beneath a grab handle, and a cable routed between the lever and a locking arrangement, wherein the lever and the cable are operable for controlling a position of the seat.

8. The compact gym of claim 1, wherein:

the frame further comprises fix plates for attaching the compact gym to a surface.

9. The compact gym of claim 1, wherein:

the frame further comprises doors adapted to enclose the frame and the exercycle when the exercycle is stored.

10. The compact gym of claim 1, wherein:

the recumbent exercycle has a backrest that is foldable for storage.

11. The compact gym of claim 1, wherein:

the frame further comprises a cupboard that is adapted to enclose the frame and the exercycle.

12. The compact gym of claim 2, wherein:

the sub-frame that carries the exercycle further comprises a transverse support that is pivotally attached to the frame, allowing the exercycle to be swivelled vertically off of a floor and into a storage orientation that is at least partially within a space defined by the frame.

13. The compact gym of claim 2, wherein:

the sub-frame carries a reciprocating locking pin that is adapted to engage with the frame to maintain the sub-frame in a stored or deployed orientation.

14. The compact gym of claim 2, wherein:

the exercycle comprises a seat supported by a parallelogram mechanism that further comprises a diagonal brace.

15. The compact gym of claim 2, wherein:

the exercycle has a seat that is supported by a diagonal brace comprises a first and a second telescopic portion, the portions being lockable by a locking pin arrangement.

16. The compact gym of claim 2, further comprising, an exercycle seat adjustment mechanism, the mechanism further comprising a lever located beneath a grab handle, and a cable routed between the lever and a locking arrangement, wherein the lever and the cable are operable for controlling a position of the seat.

17. The compact of claim 2, wherein:

the frame further comprises fix plates for attaching the compact gym to a surface.

18. The compact gym of claim 2, wherein:

the frame further comprises doors adapted to enclose the frame and the exercycle when the exercycle is stored.

19. The compact gym of claim 2, wherein:

the recumbent exercycle has a backrest that is foldable for storage.

20. The compact gym of claim 2, wherein:

the frame further comprises a cupboard that is adapted to enclose the frame and the exercycle.

* * * * *